US005962821A

United States Patent [19]

Iannetti

[11] Patent Number: 5,962,821

[45] Date of Patent: Oct. 5, 1999

[54] INTERNAL COMBUSTION ENGINE NOISE REDUCTION APPARATUS

[76] Inventor: Francesco E. Iannetti, 4913 Oak Park Rd., Raleigh, N.C. 27612

[21] Appl. No.: 08/895,459

[22] Filed: Jul. 16, 1997

Related U.S. Application Data

[63] Continuation-in-part of application No. 08/379,733, Jan. 27, 1995, Pat. No. 5,661,272.

[51] Int. Cl.[6] ..... F01N 1/24

[52] U.S. Cl. ..... 181/256; 181/252; 181/258; 181/267; 181/276

[58] Field of Search ..... 181/267, 276, 181/268, 275, 250, 252, 256, 227, 228, 224, 258, 282

[56] References Cited

U.S. PATENT DOCUMENTS

| | | |
|---|---|---|
| 582,485 | 5/1897 | Reeves . |
| 712,791 | 11/1902 | Hedstrom . |
| 1,128,306 | 2/1915 | Goelzer . |
| 1,685,701 | 9/1928 | Blanchard . |
| 1,844,105 | 2/1932 | Schnell . |
| 1,861,775 | 6/1932 | Aseltine . |
| 1,876,861 | 9/1932 | Compo . |
| 2,036,138 | 3/1936 | Haas . |
| 2,185,584 | 1/1940 | Boyce ..... 181/252 |
| 2,716,463 | 8/1955 | Latulippe . |
| 3,154,388 | 10/1964 | Purse . |
| 3,738,448 | 6/1973 | Vér et al. . |
| 3,776,365 | 12/1973 | Richards . |
| 3,786,791 | 1/1974 | Richardson . |
| 4,076,099 | 2/1978 | Proksch . |
| 4,167,986 | 9/1979 | Conway . |
| 4,595,073 | 6/1986 | Thawani . |
| 5,196,653 | 3/1993 | Kiss . |
| 5,350,888 | 9/1994 | Sager, Jr. et al. . |

*Primary Examiner*—Khanh Dang

[57] ABSTRACT

The present invention is a noise reduction apparatus for use in the exhaust system of an internal combustion engine which absorbs acoustical energy from the pressurized exhaust gases while minimizing restrictions on the exhaust gases as they flow therethrough. The relatively unrestricted exhaust gas flow provided by the present invention significantly reduces the build up of back pressure and the associated drop in power and performance of the engine. At the same time, by absorbing acoustical energy from the exhaust gases, the noise level of the exhaust system is reduced. The present noise reduction apparatus includes a housing operatively adapted for being disposed in the exhaust system of an internal combustion engine, and a plurality of sound absorbing layers disposed inside the housing. Each layer is operatively adapted to allow exhaust gases to flow therethrough while absorbing acoustical energy from exhaust gases coming in contact with the layer.

20 Claims, 2 Drawing Sheets

INTERNAL COMBUSTION ENGINE NOISE REDUCTION APPARATUS

RELATED CASES

The present application is a continuation-in-part of Ser. No. 08/379,733, now U.S. Pat. No. 5,661,272, filed Jan. 27, 1995, issued Aug. 26, 1997, entitled ENGINE NOISE REDUCTION APPARATUS and having the same inventor as the present application.

FIELD OF THE INVENTION

The present invention is related to noise reduction devices for the exhaust of an internal combustion engine, more particularly to a muffler which reduces the noise level of the exhaust while having little if any detrimental affect on the power output of the engine, and even more particularly to such a muffler for an automotive vehicle.

BACKGROUND OF THE INVENTION

Internal combustion engines typically force pressurized exhaust gases through some form of an exhaust system which pipes the exhaust gases out into the atmosphere. When engine exhaust gases are forced out into the atmosphere under high pressure (i.e., with high energy) through an opening, a high decibel sound or noise is generated as the exhaust gases are expelled. Exhaust systems have been developed with various forms of noise reduction devices (i.e., mufflers) in an effort to reduce the noise levels caused by the exiting exhaust gases. Such exhaust systems are designed so that the exhaust gases flow through one or more mufflers before they exit into the atmosphere.

In general, mufflers reduce the exhaust noise levels by restricting the flow of exhaust gases through the muffler, causing the gases to exit to atmosphere at slower rates (i.e., under less pressure). As the flow of exhaust gases is restricted, a back pressure builds up in the exhaust system. Unfortunately, as the back pressure increases, the power output (horse power) and overall performance of the engine typically suffers. Therefore, in order to maintain engine exhaust noise at tolerable levels, the engine's optimum performance level is usually sacrificed.

The performance and power output requirements for some uses of combustion engines, such as in street vehicles, are less than that required for other applications, such as in high performance race cars. With regard to exhaust noise levels, regulations governing conventional street driven vehicles typically mandate lower noise limits than the limits allowed in race car driving and other such applications, where engine performance and horse power are of primary importance.

Consequently, the muffler of a standard street vehicle is designed to reduce noise levels and allows higher exhaust back pressures to build up. In contrast, the muffler of a high performance racing engine, which requires higher performance and greater horse power than a standard street car, is designed to allow higher noise levels to be reached in order to reduce back pressures.

While comparatively high noise levels are considered less of a nuisance in applications like race car driving, there are still limits to the level of engine noise allowed during, for example, an IMSA grand prix auto race. Even mufflers designed to satisfy these more tolerant noise level requirements cause back pressures to develop which can significantly impact the performance of an engine and its horse power. Thus, regardless of how the internal combustion engine is used (e.g. in a street car, race car, lawn mower, etc.), there is a continuing need for a muffler capable of lowering exhaust noise levels without a significant detrimental affect on engine performance and power output.

SUMMARY OF THE INVENTION

This need is satisfied by providing a noise reduction apparatus for use in the exhaust system of an internal combustion engine according to the principles of the present invention, as well as by providing the exhaust system and by providing the internal combustion engine containing such a noise reduction apparatus. The present noise reduction apparatus absorbs acoustical energy from the pressurized exhaust gases while minimizing restrictions on the exhaust gases as they flow through the present noise reduction apparatus to atmosphere. The relatively unrestricted exhaust gas flow provided by the present invention reduces the build up of back pressure and the associated drop in power and performance of the engine. At the same time, by absorbing acoustical energy from the exhaust gases, the noise level of the exhaust system can be reduced.

In one aspect of the present invention, an internal combustion engine exhaust system is provided with a noise reduction apparatus which includes a plurality of sound (i.e., acoustical energy) absorbing layers disposed inside a housing. Each of the sound absorbing layers is made of an acoustical energy absorbing material, and is operatively adapted to allow exhaust gases to flow therethrough. The housing has an upstream end and a downstream end and is operatively adapted for being disposed in the exhaust system. It may be desirable for a plurality of generally concentric and radially spaced tubular sections to also be disposed inside the housing. When such tubular sections are used, each sound absorbing layer can be structurally supported by at least one of the tubular sections. Each of the tubular sections has an upstream end and a downstream end and is operatively adapted with a porous wall that allows exhaust gases to flow therethrough. In addition, each sound absorbing layer is operatively associated with one tubular section so as to allow exhaust gases to flow through the housing, from one end to the other, without having to flow through one of the sound absorbing layers. Furthermore, the present noise reduction apparatus can also be operatively adapted to allow exhaust gases to flow along its central longitudinal axis relatively unrestricted, from one end of the noise reduction apparatus to the other, such as by not having to flow through a porous wall.

It is desirable for each sound absorbing layer to also be operatively adapted to maximize the surface area of the material forming the layer so that the acoustical energy absorbed from exhaust gases which come in contact with the layer are maximized. In addition, it is desirable for each layer to be operatively associated with one tubular section so as to allow exhaust gases to flow relatively unrestricted from one end to the other of said one tubular section. This relatively unrestricted gas flow can be obtained by forming a pathway that runs lengthwise along and between any two radially adjacent tubular sections.

Each tubular section can be sheathed or otherwise surrounded by its associated sound absorbing layer. Alternatively, a sound absorbing layer can line the inside surface of or otherwise be disposed inside of each tubular section. A suitable polymeric, metallic or ceramic material or combinations thereof may be used to construct each sound absorbing layer. The material used to make each sound absorbing layer is preferably in fiber or fabric form but may also be in a particle form, cast form or any suitable combination of two or more of a particle, fiber and fabric form.

It can be desirable, for additional noise suppression, to mount a continuous or discontinuous layer of a viscous and/or elastic type material (e.g., rubber type materials) on the outer surface, the inner surface or both surfaces of the housing of the noise reduction apparatus.

There are many ways of structurally maintaining the relative spacing between the sound absorbing layers, When tubular sections are employed, some type of a mechanical spacer can be used. A plurality of spacers can be disposed between the tubular sections, at various locations along its length, a spacer can be disposed adjacent the upstream end and the downstream end of the tubular sections, or a combination of both can be used. By way of example only, the spacers can be in the form of a porous wall, which allows exhaust gases to flow therethrough, mounting one end of the tubular sections and a bracket with cross bars mounting the other end of the tubular section. The porous wall or the cross bracket could also be used exclusively at both ends of the tubular section. A cross bracket is less likely to restrict the flow of exhaust gases than the use of a porous wall. However, a porous wall may provide a greater degree of structural integrity, depending on the configuration of the porous wall.

It may be desirable for the spacer to be a truncated cone-shaped element disposed inside the housing so as to taper toward the downstream end of the housing. The truncated cone-shaped element is adapted with a porous wall which allows exhaust gases to flow therethrough. Even though it is porous, the truncated cone-shaped element still tends to compress the gas flow, which helps to reduce the noise level. The truncated cone-shaped element also has an open funnel end disposed upstream in the housing and preferably an open tapered end disposed downstream in the housing. Being open at both ends, the truncated cone-shaped element allows exhaust gases to flow along its central longitudinal axis and through the present noise reduction apparatus relatively unrestricted, such as by not having to flow through a porous wall. The cone shape causes the flow of the exhaust gases to gradually transition into the pathways between the tubular sections, resulting in improved gas flow and less turbulence (i.e., lower back pressure). The truncated cone-shaped element can disposed within each of the tubular sections. The upstream end of each tubular section can be joined to the wall of the truncated cone-shaped element. Alternatively, the upstream end of each tubular section can be disposed further downstream of the truncated cone-shaped element.

In addition to the advantages discussed above, the principles of the present invention enable a compact and light weight noise reduction apparatus to be made while maintaining satisfactory noise reduction and engine performance characteristics. Furthermore, the sound absorbing layers help in thermally insulating the noise reduction apparatus and reducing the outer temperature of the housing.

The objectives, features, and advantages of the present invention are apparent from the description disclosed herein and the appended drawings and claims.

DETAILED DESCRIPTION OF THE INVENTION

Although the present invention is herein described in terms of a specific embodiment, it will be readily apparent to those skilled in this art that various modifications, re-arrangements, and substitutions can be made without departing from the spirit of the invention. The scope of the present invention is thus only limited by the claims appended hereto.

Figure 1:
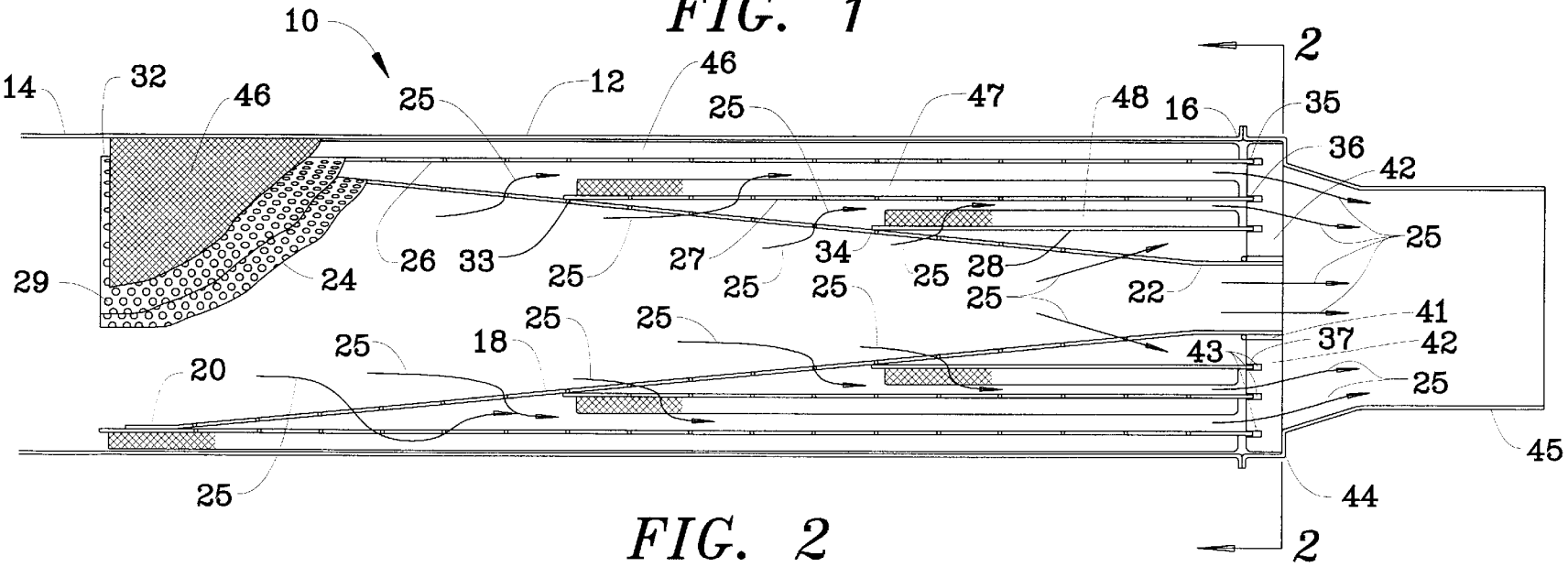
FIG. 1 is a partially broken away and sectional side view of one embodiment of the present noise reduction apparatus.
Figure 2:
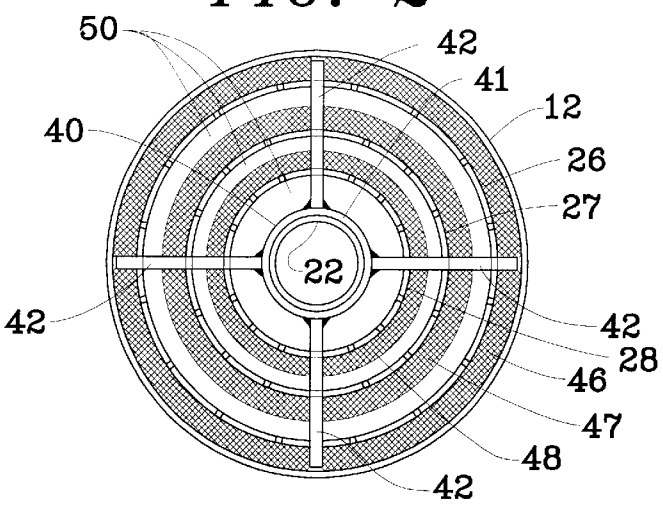
FIG. 2 is an end view of the noise reduction apparatus of FIG. 1 taken along lines 2—2.

Referring to FIGS. 1 and 2, one embodiment of a noise reduction apparatus 10 according to the principles of the present invention is used in the exhaust system (not shown) of an internal combustion engine (not shown). The noise reduction apparatus 10 absorbs acoustical energy from pressurized exhaust gases produced by the engine while minimizing restrictions on the exhaust gases as they flow through the noise reduction apparatus 10 to atmosphere. By absorbing acoustical energy from the exhaust gases, the noise level of the exhaust system is reduced. At the same time, the relatively unrestricted exhaust gas flow provided by the noise reduction apparatus 10 reduces the build up of back pressure and the associated drop in power and performance of the engine.

The exemplary noise reduction apparatus 10 includes a tubular housing 12 having an upstream end 14 and a downstream end 16 operatively adapted for being disposed, for example, in an exhaust system of a conventional internal combustion engine, like that typically found in automobiles, airplanes, boats, etc. Methods for disposing noise reduction devices in an engine exhaust system are well known. The method for so disposing the noise reduction apparatus forms no basis for the present invention and will therefore not be discussed in detail herein. A suitable housing 12 can be made from Inconel 625 sheet metal, having a wall thickness of about 0.040 inches. Less expensive metals or other materials such as, for example, graphite-epoxy composites can also be used, depending on the working environment of the particular exhaust system.

A truncated cone-shaped element 18 is disposed inside the housing 12. The truncated cone-shaped element 18 has an open funnel end 20 disposed adjacent the upstream end 14 of the housing 12 and preferably an open tapered end 22 disposed adjacent the downstream end 16 of the housing 12. The truncated cone-shaped element 18 is adapted with a substantially perforated wall 24 to allow exhaust gases, as depicted by arrows 25, to flow therethrough. Preferably, the wall 24 has as high a degree of perforation as possible, without critically affecting its structural integrity. The degree of perforation is defined as the area of perforations per unit surface area of wall. A suitable truncated cone-shaped element 18 can be made out of Inconel 625 sheet metal having a wall thickness of about 0.032 inches and approximately 48% of its surface area perforated with about 3/16 inch diameter holes separated from each other on their centers by about 1/4 inch. Instead of being open, as shown, it is believed that satisfactory results can be obtained if the open tapered end 22 of truncated cone-shaped element 18 is enclosed by the perforated wall (e.g., a wire mesh).

At least one and preferably a plurality of generally concentric and radially spaced tubes are disposed inside the housing 12 and outside the truncated cone-shaped element 18. In the exemplary embodiment of FIGS. 1 and 2, a first tube 26, second tube 27 and third tube 28 are shown. As with the truncated cone-shaped element 18, each of the tubes 26–28 is adapted with a substantially perforated wall to allow exhaust gases 25 to flow therethrough. The wall of tube 26 (designated with the reference number 29) is shown in a partially broken away view. The walls of the other tubes 27 and 28 are similarly perforated. Preferably, the walls of the tubes 26–28 each have as high a degree of perforation as possible, without critically affecting their structural integrity. Suitable tubes 26–28 can be made out of the same Inconel 625 sheet metal as that used to make the truncated cone-shaped element 18, including having a wall thickness of about 0.032 inches and approximately 48% of its surface area perforated with about 3/16 inch diameter holes separated from each other on their centers by about ¼ inch. The third tube 28 has a smaller diameter than the second tube 27 and is disposed concentrically within the second tube 27. Similarly, the second tube 27 has a smaller diameter than and is disposed concentrically within the first tube 26. Each of the tubes 26, 27 and 28 has an upstream end 32, 33 and 34 and a downstream end 35, 36 and 37, respectively. The upstream ends 32–34 are longitudinally staggered relative to one another, and the downstream ends 35–37 are, in general, longitudinally even with one another. The truncated cone-shaped element 18 is disposed within each of the tubes 26–28.

The upstream ends 32–34 of the tubes 26–28 can be joined by any suitable means (e.g., by welding, brazing, mechanical fastener, etc.) to the wall 24 of the truncated cone-shaped element 18. In this way, the truncated cone-shaped element 18 functions as a spacer to maintain the upstream ends 32–34 of the tubes 26–28 in their radially spaced apart relationship. The downstream ends of the housing 12, truncated cone-shaped element 18 and tubes 26–28 are kept in a radially spaced apart relation by a different form of a spacer, such as a cross bracket 40. Bracket 40 can be of any suitable configuration which sufficiently maintains the radial relationship between the downstream ends of the housing 12, truncated cone-shaped element 18 and tubes 26–28 while only slightly restricting the flow of exhaust gases out of the apparatus 10, if at all. Bracket 40 has a tubular hub 41 with four cross bars 42 extending radially out therefrom. The downstream tapered end 22 of truncated cone-shaped element 18 is disposed inside hub 41. The downstream end of each tube 26–28 is received in a spacer notch 43 formed in each cross bar 42. Each cross bar 42 has a total of three spacer notches 43, one for each tube 26–28.

Bracket 40 may be integrally fixed in place by any suitable means, such as welding, brazing, etc. Preferably, only one end of each tube 26–28 is integrally fixed in place, to allow for thermal expansion. To accomplish this, bracket 40 may be kept in place by an end cap 44 fixed to the downstream end 16 of housing 12. End cap 44 could also be used to keep the tubes 26–28 in position without their upstream ends 32–34 having to be joined to the cone wall 24. End cap 44 may include a tailpipe section 45 for directing the exhaust gases 25 out to atmosphere. It is preferable for apparatus 10 to be used without an end cap 44 and tailpipe section 45, because these elements tend to restrict the flow of exhaust gases 25 through apparatus 10.

It is believed that satisfactory results can be obtained if the truncated cone-shaped element 18 is replaced with another spacer similar to bracket 40 for maintaining the radial spacing of the upstream ends 32–34 of the tubes 26–28. To use two brackets 40, one at either end, all the tubes 26–28 should be the same length and longitudinally in line with each other. Even without the truncated cone-shaped element 18, the longitudinally staggered relation of the upstream ends 32–34 can be maintained by using a separate spacer (not shown) for each upstream end 32–34. The separate spacers could be similar to bracket 40, but with increasingly larger hubs (going in the upstream direction) to approximate the shape of the tapered wall 24 of truncated cone-shaped element 18. Accordingly, the upstream and downstream ends of tubes 26–28 can be longitudinally staggered or even with one another.

There are also a plurality of sound absorbing layers 46, 47 and 48, one associated with each tube 26 27 and 28, respectively. It has been found desirable to sheath or otherwise surround each tube 26–28 with its associated sound absorbing layer 46–48. Alternatively, the inside surface of each tube 26–28 can be lined or otherwise disposed with its associated sound absorbing layer 46–48. Each sound absorbing layer 46–48 is made of a suitable acoustical energy absorbing polymeric, metallic or ceramic material or combinations thereof The material used to make each sound absorbing layer 46–48 is preferably in fiber or fabric form, but each layer 46–48 can also be in particle form. The fibers or particles used could be of any suitable size or shape. For example, the fibers could be short needles or long threads.

Each cross bar 42 of bracket 40 can be in the form of a fin, blade or guide vane, for example, such as that used for a turbine blade. A plurality of the fins 42 can be mounted as shown, as described above, or between the sound absorbing layers 46–48 or the tubes 26–28 and angled so as to direct exhaust gas, passing through the noise reduction apparatus, to spiral around the central longitudinal axis of the noise reduction apparatus. These fins 42 can be mounted so a to be fixed in place or, for example, with bearings so as to spin around the central longitudinal axis of the noise reduction apparatus. It is believed desirable to use a free spinning turbine wheel made as light as practical (e.g., from a ceramic material) mounted at the upstream end of truncated cone-shaped element 18 with bearings exhibiting the least resistance feasible, such as with an air bearing. Depending on the location of such fins or blades 42, such spiraling of the exhaust gas can occur throughout the noise reduction apparatus or just at the downstream end of the noise reduction apparatus. It is believed that the acoustical efficiency of the noise reduction apparatus can be dramatically improved by spiraling the exhaust gases in this manner, resulting in a much quieter exhaust system. For maximum fluid flow and acoustical efficiency, it is believed desirable for the perforations in the element 18 to be aligned in a spiral pattern. It is believed that such a spiral pattern will reduce flow resistance into the sound absorbing layers and continue the spiral rotation of the exhaust flow into these layers. It is believed that such spiraling of the exhaust gases will effectively increase the length (the acoustical length) of the noise reduction apparatus (i.e., the amount of time the exhaust noise remains inside the noise reduction apparatus and in contact with the sound absorbing layers).

Satisfactory sound absorbing layers have been formed by wrapping multiple layers of a ceramic fiber, Nextel 312, manufactured by 3M, St. Paul, Minn., around the outside of each tube 26–28 in a criss-crossing pattern. Each layer 46–48 should be wrapped with enough fiber to provide the surface area needed to optimize the acoustical energy absorption. At the same time, the fibers in each layer 46–48 should be sufficiently spaced to provide the degree of porosity needed to allow the exhaust gases to flow therethrough without too much back pressure being generated. The optimum amount of acoustical energy absorbing surface area and degree of porosity for the layers used can vary depending on the particular application in which the noise reduction apparatus of the present invention is used. For example, in general, it would likely be more acceptable to allow a higher noise level but less back pressure (i.e., reducing the amount of surface area and increasing the degree of porosity in the layer) in a race car application than in a street car application. It is understood that the appearance of the layers 46–48 in cross section, as partially shown in both FIGS. 1 and 2, is not how the layers 46–48 appear in true cross section. Each tube 26–28 of wound fiber can be wrapped with a screen or wire mesh.

If short fibers or small particles are used, they will likely need to be maintained in position and prevented from moving about within the housing 12 in order to prevent the loss of the noise absorbing material and the clogging of the holes formed through the walls of the truncated cone-shaped element 18 and tubes 26–28. For example, the short fibers or particles could be sintered or otherwise bonded together or encapsulated in some way, such as with a screen. Furthermore, with time, portions of the layers 46–48 made from long fibers or fabric may fracture off. Therefore, it may also be desirable to somehow bond together or encase sound absorbing layers 46–48 formed using wound fibers or fabric to prevent fractured portions from moving about within the housing. In addition, it may be desirable to make each sound absorbing layer out of any suitable combination of one or more of these forms (i.e., particle, fiber and fabric). The material and form used for the sound absorbing layers 46–48 will likely be dependant upon how and where the noise reduction apparatus 10 is being used. For example, higher performance and likely more expensive materials, such as high temperature, high strength and high toughness materials, may be necessary in high performance race cars or other applications which subject the apparatus to very severe working conditions.

Thus, each of the sound absorbing layers 46–48 is operatively adapted to allow exhaust gases to flow therethrough and to absorb acoustical energy from exhaust gases flowing therethrough or otherwise coming in contact with the layer. In addition, each layer is operatively associated with one tube so as to allow exhaust gases to flow relatively unrestricted from one end to the other of the one tube. This relatively unrestricted flow of exhaust gases can be accomplished by adapting each sound absorbing layer 46–48 and spacing apart the tubes 26–28 so that a pathway 50 is formed that runs lengthwise from one end to the other along and between any two radially adjacent tubes as well as between the truncated cone-shaped element 18 and the innermost tube 28. The apparatus 10 can also be operatively adapted to allow exhaust gases to flow along its central longitudinal axis relatively unrestricted, from one end of said apparatus 10 to the other, such as by not having to flow through a porous wall.

Figure 3:
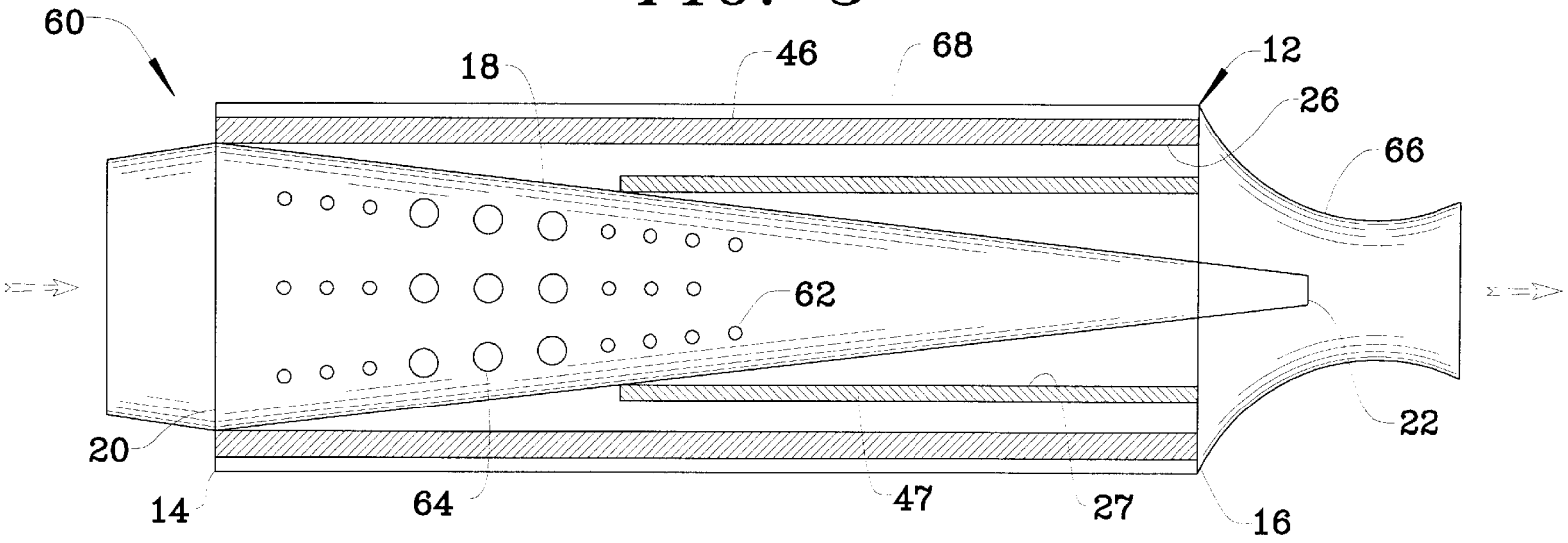
FIG. 3 is partially sectional side view of another embodiment of the present noise reduction apparatus.

Referring to FIG. 3, another embodiment 60 of the present noise reduction apparatus includes many of the same, or very similar, structural elements as the previously described noise reduction apparatus 10. Therefore, the same reference numerals will be used when the same or similar elements are described. Apparatus 60 includes a tubular housing 12 having an upstream end 14 and a downstream end 16 operatively adapted for being disposed, for example, in an exhaust system of a conventional internal combustion engine. A truncated cone-shaped element 18 is disposed inside the housing 12. The truncated cone-shaped element 18 has an open funnel end 20 at its upstream end and an open tapered end 22 at its downstream end. At least one and preferably a plurality of generally concentric and radially spaced tubes are disposed inside the housing 12 and outside the truncated cone-shaped element 18. In the exemplary embodiment of FIG. 3, a first tube 26 and a second tube 27 are shown. Each of the tubes 26 and 27 are as described above. There are also a plurality of sound absorbing layers 46 and 47, one associated with each tube 26 and 27, respectively, as described above.

The truncated cone-shaped element 18 is adapted with a substantially perforated wall 24 as described above except that the perforations include smaller openings 62 and larger openings 64. The larger openings 64 are located adjacent to the upstream ends of the tubular sections (i.e., at the upstream entrance to the space between the absorbing layers 46 and 47). It is believed that the use of such lager openings 64 will help to minimize back pressure. The apparatus 60 also includes a venturi shaped tail pipe 66. It is believed that the tail pipe 66 will increase the velocity around the absorbing layers 46 and 47 by increasing the velocity of the exhaust gases as they exit the apparatus 60. This tailpipe can also be made as a sound absorbing structure such as, a perforated body wrapped with sound absorbing material as described above. It is also believed that, to maximize efficiency, it is desirable for the downstream end 22 of the truncated cone-shaped element 18 to be located around the low pressure or center section of the venturi shaped tail pipe 66, as shown.

For additional noise suppression, it is desirable to mount one or more continuous or discontinuous layers 68 of a viscous and/or elastic type material on the outer surface, the inner surface (e.g., between the housing 12 and the sound absorbing layer 46) or both surfaces of the housing 12 of the noise reduction apparatus 60. A viscous and/or elastic type material refers to any material (e.g., rubber type materials, other polymers, glass-like materials, etc.) that absorb sound that is transmitted to the outside of the housing 12. It is believed that the layer 68 could be made from a material that softens at the operating temperature of the noise reduction apparatus 60. It is believed that the layer 68 could also be a liquid contained in some form of a tubular bladder. It has been found that the thermal insulating ability of some materials that can be used for the sound absorbing layers 46–48 (e.g., ceramic materials) results in the housing 12 having a lower temperature, than is typically expected, during the operation of the internal combustion engine. This lower housing temperature enables each sound absorbing layer 68 of viscous and/or elastic type materials to be in contact with or in close proximity to the housing without burning or otherwise degrading.

Figure 4:
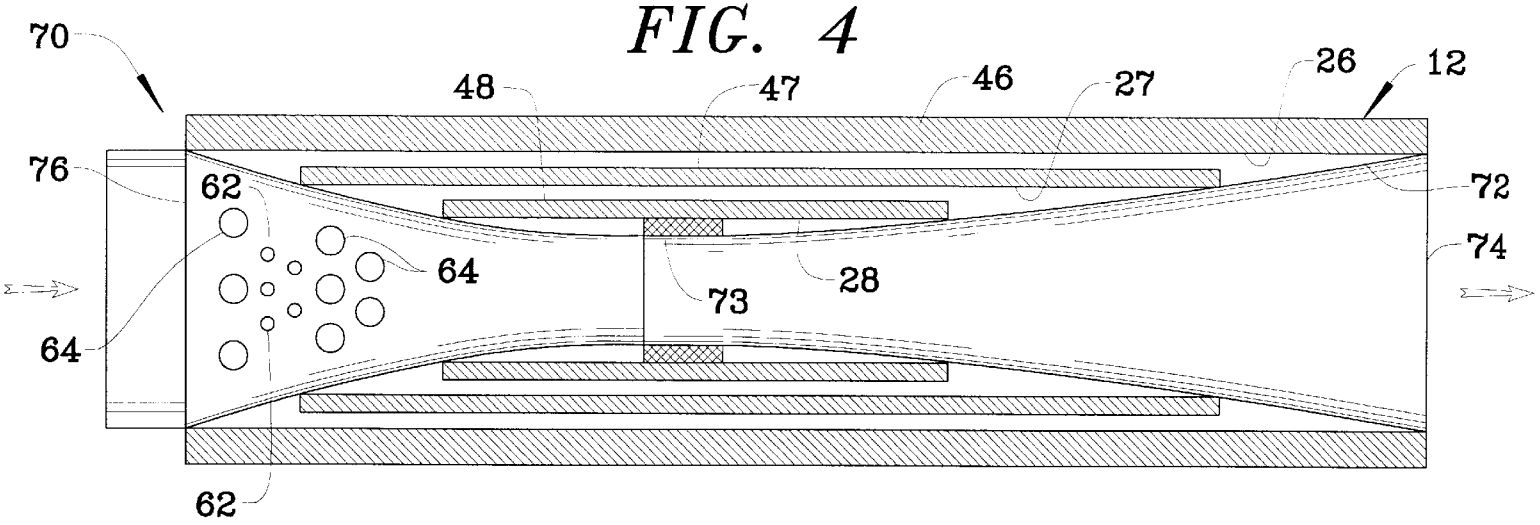
FIG. 4 is partially sectional side view of another embodiment of the present noise reduction apparatus.

Referring to FIG. 4, an alternative embodiment 70 of the present noise reduction apparatus has a truncated hour glass shaped element 72 instead of the truncated cone-shaped element 18 described above. Except for its shape, element 72 can be described as element 18 is described above. In this way, the entire noise reduction apparatus 70 can be designed as a venturi to maximize exhaust gas flow. Element 72 can be formed by inserting the tapered end of two truncated cone-shaped elements 18 one inside the other to form a slip joint 73. The apparatus 70 includes a housing 12, tubes 26–28, sound absorbing layers 46–48 and openings 62 and 64, as described above. No support bracket 40 is necessary because the element 72 has two expanded ends 74 and 76 (i.e., the tapered ends of the two elements 18 are fit into each other). While the apparatus 70 may result in a smaller absorption layer surface to volume ratio than exhibited by apparatus 10 or 60, it is believed that apparatus 70 will experience less back pressure.

From the above disclosure of the general principles of the present invention and the preceding detailed description, those skilled in this art will readily comprehend the various modifications to which the present invention is susceptible. Therefore, the scope of the invention should be limited only by the following claims and equivalents thereof.

What is claimed is:

1. An apparatus comprising:

an internal combustion engine;

an exhaust system through which exhaust gases from said engine exit to atmosphere; and a noise reduction apparatus for reducing the sound level of exhaust gases exiting said exhaust system, said noise reduction apparatus comprising:

a housing mounted within said exhaust system so that exhaust gases can pass through said apparatus, said housing having an upstream end through which exhaust gases enter said apparatus and a downstream end through which exhaust gases exit said apparatus, and a plurality of tubular sound absorbing layers mounted within said housing so as to be radially spaced apart relative to one another, each of said plurality of sound absorbing layers having an upstream end, being sufficiently porous to allow exhaust gases to flow therethrough and being operatively adapted to absorb acoustical energy from exhaust gases coming in contact therewith, wherein said noise reduction apparatus is operatively adapted to allow at least some exhaust gases to flow therethrough relatively unrestricted, from one end of said noise reduction apparatus to the other, such as by not having to flow through a porous wall.

2. The apparatus of claim 1, said sound absorbing layers being mounted inside of said housing such that the upstream ends of said sound absorbing layers are longitudinally staggered relative to one another so as to generally define a truncated cone shape.

3. The apparatus of claim 1, said noise reduction apparatus having a central longitudinal axis and being operatively adapted to allow exhaust gases to flow along its central longitudinal axis relatively unrestricted, from one end of said noise reduction apparatus to the other, such as by not having to flow through a porous wall.

4. The apparatus of claim 1, further comprising a plurality of tubular sections mounted inside of said housing, each of said tubular sections having a porous wall, each of said sound absorbing layers being supported by at least one of said tubular sections, and said noise reduction apparatus being operatively adapted to allow exhaust gases to flow therethrough, from one end to the other, without having to flow through the porous wall of one of said tubular sections.

5. The apparatus of claim 1, each of said sound absorbing layers being made of an acoustical energy absorbing material in a form selected from the group consisting of acoustical energy absorbing particles, fiber, fabric and combinations thereof.

6. The apparatus of claim 1, said noise reduction apparatus further comprising a truncated cone-shaped element mounted inside of said housing with a tapering end disposed toward the downstream end of said housing, said truncated cone-shaped element having a porous wall adapted to allow exhaust gases to flow therethrough, and each of said sound absorbing layers being mounted radially outside of and so as to longitudinally overlap said truncated cone-shaped element.

7. The apparatus of claim 1, wherein each of said sound absorbing layers has a downstream end and said noise reduction apparatus further comprises a bracket mounted to said housing so as to maintain the downstream end of said sound absorbing layers radially spaced apart.

8. The apparatus of claim 7, wherein said bracket has a plurality of braces, each brace is in the form of a fin that is angled so as to direct exhaust gas, passing through the downstream end of said noise reduction apparatus, to spiral around the central longitudinal axis of said noise reduction apparatus.

9. The apparatus of claim 1, said noise reduction apparatus further comprising a spacer mounted within said housing so as to maintain the spacial relationship between said sound absorbing layers, said spacer comprising a plurality of fins mounted between said sound absorbing layers and being angled so as to direct exhaust gas, passing through said noise reduction apparatus, to spiral around the central longitudinal axis of said noise reduction apparatus as the exhaust gas passes through said noise reduction apparatus.

10. The apparatus of claim 1, said housing having an outer surface and an inner surface, and said noise reduction apparatus includes at least one layer of a viscous and/or elastic type material mounted on at least one of the outer surface or inner surface of said housing.

11. An internal combustion engine exhaust system through which exhaust gases from an engine exit to atmosphere, said exhaust system comprising:

a noise reduction apparatus for reducing the sound level of exhaust gases exiting said exhaust system, said noise reduction apparatus comprising:

a housing mounted within said exhaust system so that exhaust gases can pass through said apparatus, said housing having an upstream end through which exhaust gases enter said apparatus and a downstream end through which exhaust gases exit said apparatus, and a plurality of tubular sound absorbing layers mounted within said housing so as to be radially spaced apart relative to one another, each of said plurality of sound absorbing layers having an upstream end, being sufficiently porous to allow exhaust gases to flow therethrough and being operatively adapted to absorb acoustical energy from exhaust gases coming in contact therewith, wherein said noise reduction apparatus is operatively adapted to allow at least some exhaust gases to flow therethrough relatively unrestricted, from one end of said noise reduction apparatus to the other, such as by not having to flow through a porous wall.

12. The exhaust system of claim 11, said sound absorbing layers being mounted inside of said housing such that the upstream ends of said sound absorbing layers are longitudinally staggered relative to one another so as to generally define a truncated cone shape.

13. The exhaust system of claim 11, said noise reduction apparatus having a central longitudinal axis and being operatively adapted to allow exhaust gases to flow along its central longitudinal axis relatively unrestricted, from one end of said noise reduction apparatus to the other, such as by not having to flow through a porous wall.

14. The exhaust system of claim 11, further comprising a plurality of tubular sections mounted inside of said housing, each of said tubular sections having a porous wall, each of said sound absorbing layers being supported by at least one of said tubular sections, and said noise reduction apparatus being operatively adapted to allow exhaust gases to flow therethrough, from one end to the other, without having to flow through the porous wall of one of said tubular sections.

15. The exhaust system of claim 11, each of said sound absorbing layers being made of an acoustical energy absorbing material in a form selected from the group consisting of acoustical energy absorbing particles, fiber, fabric and combinations thereof.

16. The exhaust system of claim 11, said noise reduction apparatus further comprising a truncated cone-shaped element mounted inside of said housing with a tapering end disposed toward the downstream end of said housing, said truncated cone-shaped element having a porous wall adapted to allow exhaust gases to flow therethrough, and each of said sound absorbing layers being mounted radially outside of and so as to longitudinally overlap said truncated cone-shaped element.

17. The exhaust system of claim 11, wherein each of said sound absorbing layers has a downstream end and said noise reduction apparatus further comprises a bracket mounted to said housing so as to maintain the downstream end of said sound absorbing layers radially spaced apart.

18. The exhaust system of claim 17, wherein said bracket has a plurality of braces, each brace is in the form of a fin that is angled so as to direct exhaust gas, passing through the downstream end of said noise reduction apparatus, to spiral around the central longitudinal axis of said noise reduction apparatus.

19. The exhaust system of claim 11, said noise reduction apparatus further comprising a spacer mounted within said housing so as to maintain the spacial relationship between said sound absorbing layers, said spacer comprising a plurality of fins mounted between said sound absorbing layers and being angled so as to direct exhaust gas, passing through said noise reduction apparatus, to spiral around the central longitudinal axis of said noise reduction apparatus as the exhaust gas passes through said noise reduction apparatus.

20. The exhaust system of claim 11, said housing having an outer surface and an inner surface, and said noise reduction apparatus includes at least one layer of a viscous and/or elastic type material mounted on at least one of the outer surface or inner surface of said housing.

* * * * *